United States Patent [19]

Ikuta et al.

[11] Patent Number: 4,823,160

[45] Date of Patent: Apr. 18, 1989

[54] METHOD AND APPARATUS FOR LOADING/UNLOADING A DRUM MEMBER

[75] Inventors: Hirotoshi Ikuta, Yokohama; Akira Takayama, Yamato, both of Japan

[73] Assignee: Fujitsu Limited, Kawasaki, Japan

[21] Appl. No.: 50,393

[22] Filed: May 18, 1987

[30] Foreign Application Priority Data

May 20, 1986 [JP] Japan ..... 61-116401

[51] Int. Cl.[4] ..... G03G 15/00

[52] U.S. Cl. ..... 355/3 DR; 355/3 R

[58] Field of Search ..... 355/3 DR, 3 R

[56] References Cited

U.S. PATENT DOCUMENTS

| | | | |
|---|---|---|---|
| 3,536,397 | 10/1970 | Van Wagner | 355/3 DR |
| 3,695,757 | 10/1972 | Gregory | 355/3 DR X |
| 3,994,053 | 11/1976 | Hunt | 355/3 DR X |
| 4,076,402 | 2/1978 | Kanno et al. | 355/3 DR |
| 4,120,576 | 10/1978 | Babish | 355/3 DR |
| 4,134,667 | 1/1979 | Schnall et al. | 355/3 DR |
| 4,134,669 | 1/1979 | Reitner | 355/3 DR |
| 4,527,883 | 7/1985 | Kamiyama | 355/3 DR |
| 4,659,206 | 4/1987 | Kai et al. | 355/3 DR |

FOREIGN PATENT DOCUMENTS 2051682 1/1981 United Kingdom .

OTHER PUBLICATIONS

European Search Report dated 8/26/87.

*Primary Examiner*—Arthur T. Grimley
*Assistant Examiner*—Edward Pipala
*Attorney, Agent, or Firm*—Staas & Halsey

[57] ABSTRACT

An apparatus for loading/unloading a drum member and a related method are described. The apparatus includes an inner support member slidably arranged between a center shaft fixed to a frame and a drum member. When the drum member is required to be unloaded from the frame, the inner support member is ejected along the center shaft for a predetermined length, and then the drum member is drawn out while using the inner support member as a guide. The method includes the steps of: providing a center shaft secured at one end to the frame; providing an inner support member slidably attached to the center shaft; providing a drum member supported at its inner surface by the inner support member and being slidable along the center shaft axis; drawing out the inner support member for a predetermined length toward the outside of the frame; and drawing out the drum member toward the outside of the frame, while using the inner support member as a guide. By this apparatus and method, the drum can be drawn out easily and safely while using the inner support member as a guide.

16 Claims, 9 Drawing Sheets

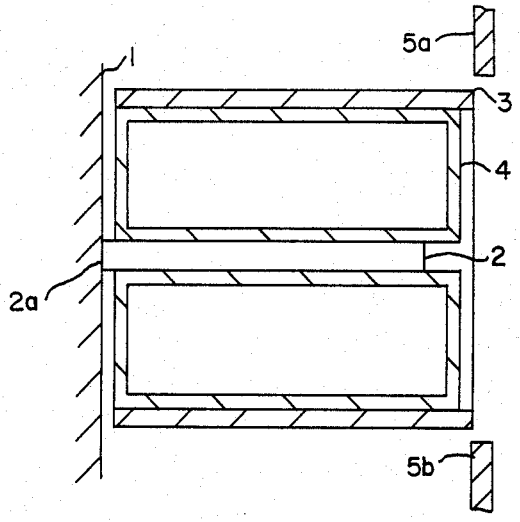
FIG.1A
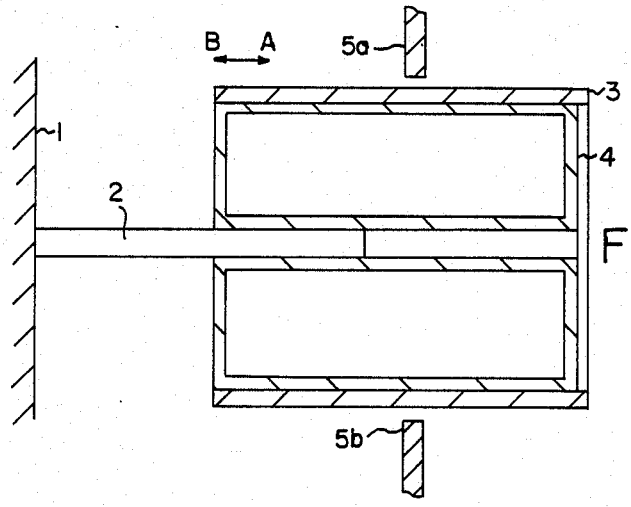
FIG.1B
FIG.1C
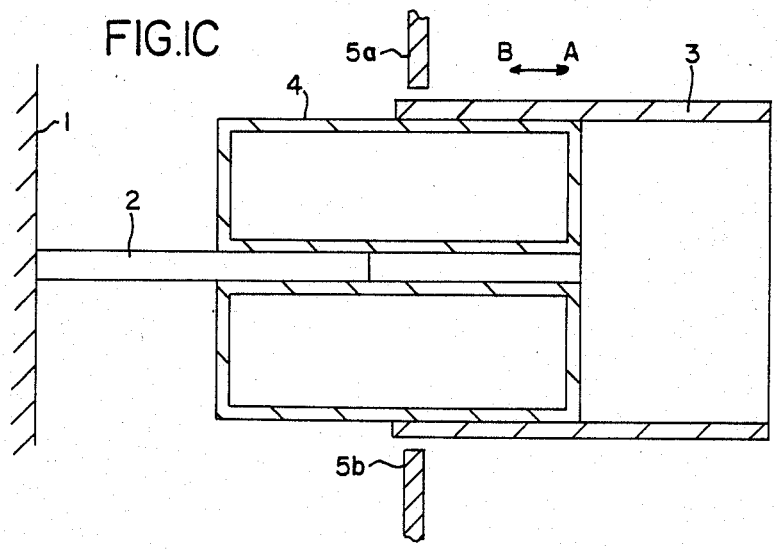

FIG.4A
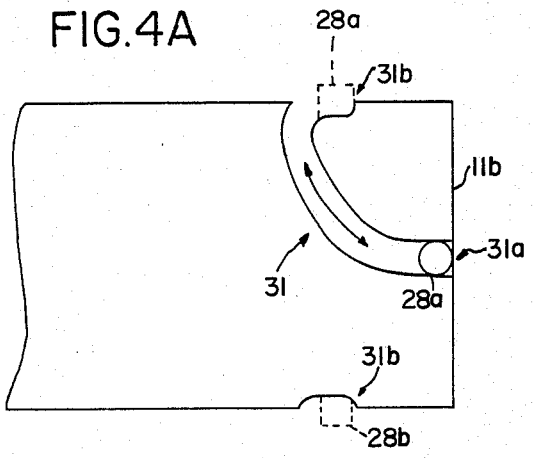
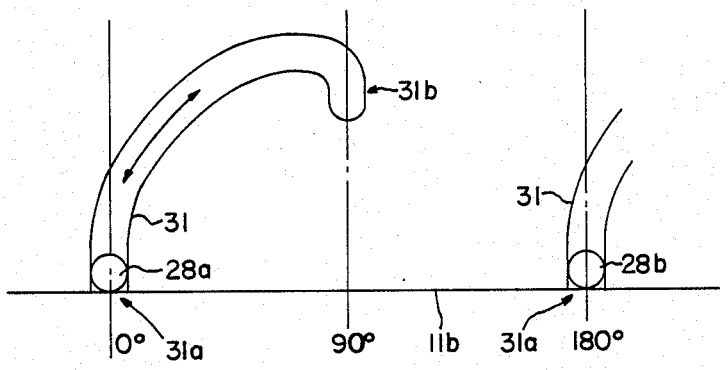
FIG.4B

METHOD AND APPARATUS FOR LOADING/UNLOADING A DRUM MEMBER

BACKGROUND OF THE INVENTION

This invention relates to a method and an apparatus for loading/unloading a drum member relative to a frame in which the drum member is used.

In an electro-photographic printing apparatus or an electro-photographic copier, an electro-static latent image forming drum coated with photosensitive material is provided. In such apparatus, many associated devices such as a corona charger, a developer, pre-cleaning decharger, etc. are arranged close to the drum. Therefore, when the drum is to be loaded into or unloaded from the frame for inspections or replacement, very careful handling is required, or else the drum will be damaged by hitting these devices.

Damage to the drum is also likely in a magnetic drum memory apparatus or any other apparatus including a sensitive drum member provided with associated devices in its vicinity.

The drum member is usually supported by a center shaft, which is secured at one end to the frame of the apparatus. The other end of the center shaft is free or easily detachably fixed to the frame.

A conventional method of loading/unloading the drum includes the steps of connecting a separate tool such as an extension rod to the free end of the center shaft for elongating or extending the center shaft, and drawing out the drum while guiding the drum along the extension rod.

Another prior art method, as shown in Japanese laid-opened patent application Tokkaisho No. 60-15942, includes the steps of providing a center shaft made as a pipe, providing a special rod having a length longer than the length of the drum, inserting the rod into the center shaft pipe, securing one end of the rod to the frame, detaching the center shaft, and then drawing out both the drum and center shaft together.

In either prior art method, a special tool, such as the extension rd, must be provided and also a space for housing this tool must be provided in the frame. Therefore, the size of the frame becomes undesirably larger.

Furthermore, a maintenance person is required to expend much labor to attach and detach the tool every time the drum is loaded/unloaded.

In addition, such electro-photographic apparatus is generally provided with an electric power switch which cooperates with the opening/closing of a front door thereof so that the power supply is cut when the door is opened. In the case where the tool is housed within the frame, and a maintenance person forgets to store the tool in the frame, the front door must be opened once again, and restarting the apparatus is undesirably delayed. This delay includes not only the time required for opening and closing the door, but also warm-up time.

SUMMARY OF THE INVENTION

Accordingly, it is an object of this invention to provide a method and an apparatus for loading/unloading a drum member relative to a frame easily and without substantial labor.

It is another object of this invention to provide a method and an apparatus for loading/unloading a drum member relative to a frame without requiring extra space for housing a tool in the frame.

To achieve the foregoing and other objects of the present invention and in accordance with the purposes of the invention, there is provided an apparatus for loading/unloading a drum member and a related method.

The apparatus includes: a center shaft secured at one end to a frame; an inner support member slidably attached to the center shaft; and a drum member having an inner diameter substantially equal to the outer diameter of the inner support member and being rotatable on and slidable along the center shaft.

The method includes the steps of: providing a center shaft secured at one end to the frame; providing an inner support member slidably attached to the center shaft; providing a drum member supported at its inner surface by the inner support member and being slidable along the center shaft axis; drawing out the inner support member for a predetermined length toward the outside of the frame; and drawing out the drum member toward the outside of the frame, while using the inner support member as a guide.

According to this apparatus and method, the drum can be drawn out easily and safely by using the inner support member as a guide.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 1A is a cross-sectional view showing the apparatus of the present invention with the drum loaded according to the present invention.

FIG. 1B is a cross-sectional view showing the drum being unloaded according to the present invention.

FIG. 1C is a cross-sectional view showing a final step in the unloading of the drum according to the present invention.

FIG. 4A is a partial side view of one end of the center shaft of the embodiment shown in FIG. 2.

FIG. 4B is a flattened circumferential view of FIG. 4A.

DETAILED DESCRIPTION OF THE PREFERRED EMBODIMENTS

Figure 2:
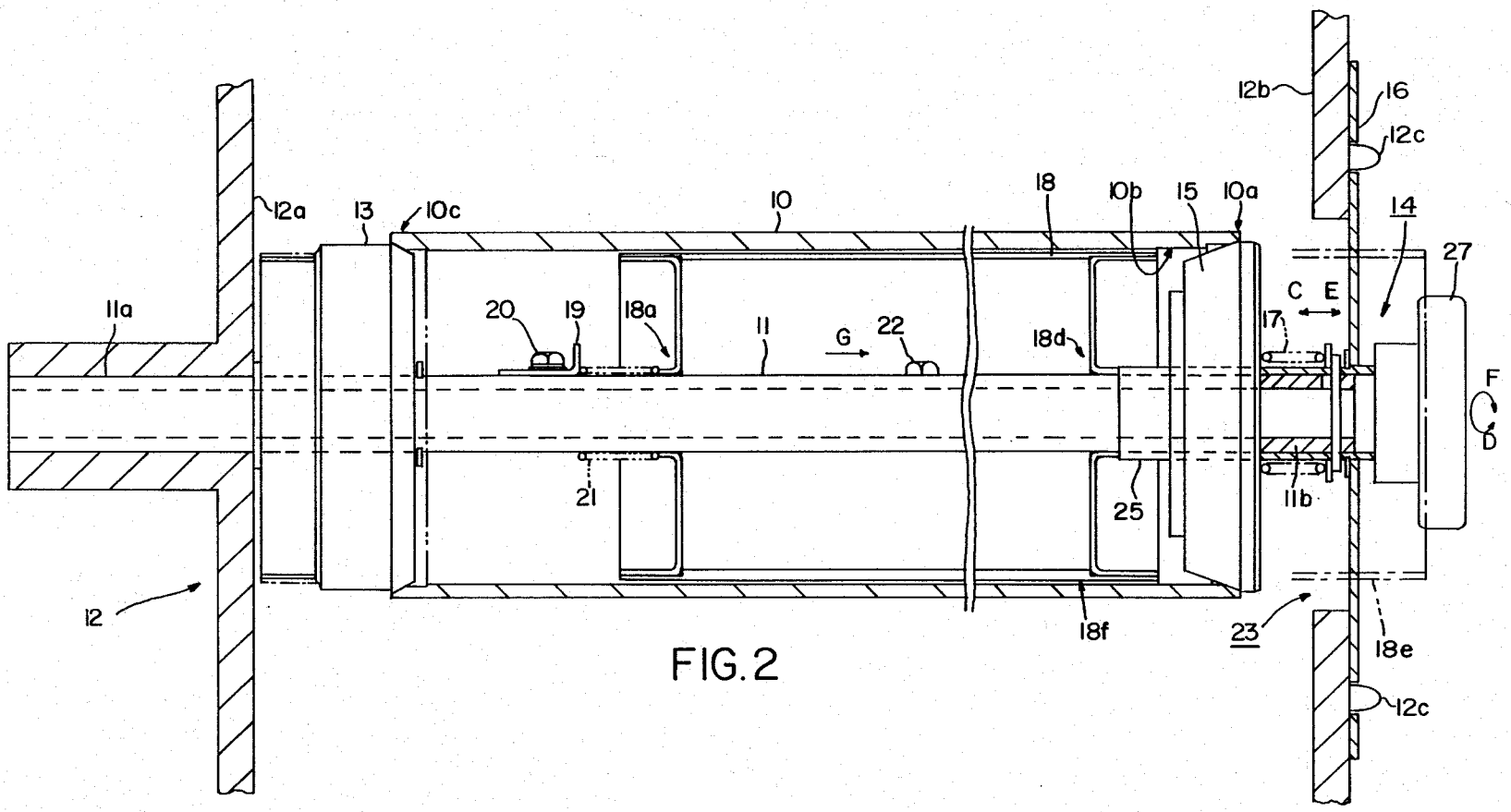
FIG. 2 is a partial cross-sectional view of a first embodiment of an electro-photographic apparatus according to the present invention.

FIGS. 1A–1C illustrate generally the present invention, including: a center shaft 2 is secured at a first end 2a to a portion of the frame 1, an inner support member 4 is attached to the center shaft 2 such that it is slidable in the direction of the axis of the center shaft 2 as indicated by an arrow BA; and a drum 3, having an inner diameter substantially the same as the outer diameter of the inner support member 4. Members 5a and 5b are parts of the front of the frame 1 of the apparatus.

When the apparatus is in operation, both the inner support member 4 and the drum 3 are housed within the frame 1 as shown in FIG. 1A. When the drum 3 is required to be unloaded, the inner support member 4 and the drum 3 are drawn out in the direction A for a predetermined length, as shown in FIG. 1B, and then the drum 3 is further drawn out in the direction A, while using the inner support member 4 as a guide, as shown in FIG. 1C. When re-loading of the drum 3 is required, the reverse steps are followed.

FIG. 2 shows a partial, cross-sectional elevational view of a first embodiment of the present invention. A center shaft 11 is secured at a first end 11a to a part 12a of the frame 12, and detachably secured at its second, opposite end 11b to the front 12b of the frame via a cover assembly 14. An inner support member 18 is attached to the center shaft 11 via flanges 18a and 18d thereof and is slidable in the direction of the axis of the center shaft 11 as indicated by an arrow CE. A coil spring 21 is provided on the center shaft 11, between a stopper 19 secured to the center shaft by a screw 20 and the flange 18a, so that the spring 21 forces the inner support member 18 toward the outside of the frame 12, namely in the direction indicated by arrow G. The outer diameter of the inner support member 18 is almost equal to the inner diameter of a drum member 10 so that the outer surface 18f of the inner support member 18 can support and guide the inner surface 10b of the drum member 10.

This drum member 10 is, for example, a latent image developing drum for an electro-photographic printing apparatus, coated with a photosensitive material at its outer surface. Many associated known devices required to develop the latent image, such as a corona charger, a toner developer device, an optical system, a preclean corona decharger etc., are omitted from the figure for simplicity and convenience.

Figure 5:
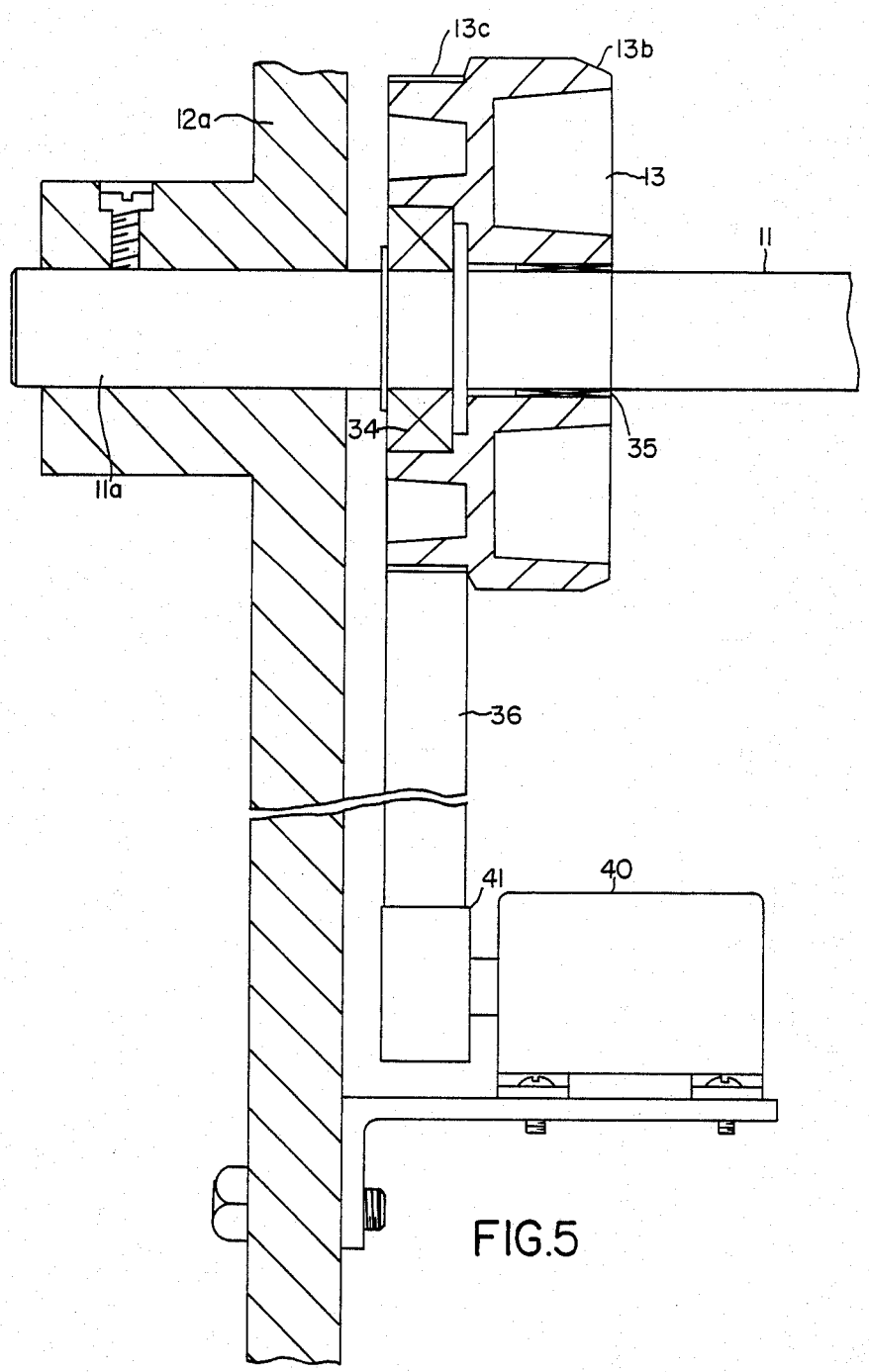
FIG. 5 is a partially enlarged cross-sectional view of a drive flange of the embodiment shown in FIG. 2.

When rotated in operation, the drum member 10 is sandwiched and supported between a drive flange 13 and a support flange 15. The drive flange 13, as shown more in detail in FIG. 5, has a tapered rim 13b and a timing gear 13c. The rim 13b is partially inserted into a first end 10c of the drum member 10. The timing gear 13c is connected to a timing gear 41 of a motor 40 via a timing belt 36. The drive flange 13 is rotatable around the center shaft 11 by means of bearings 34 and 35.

Figure 3:
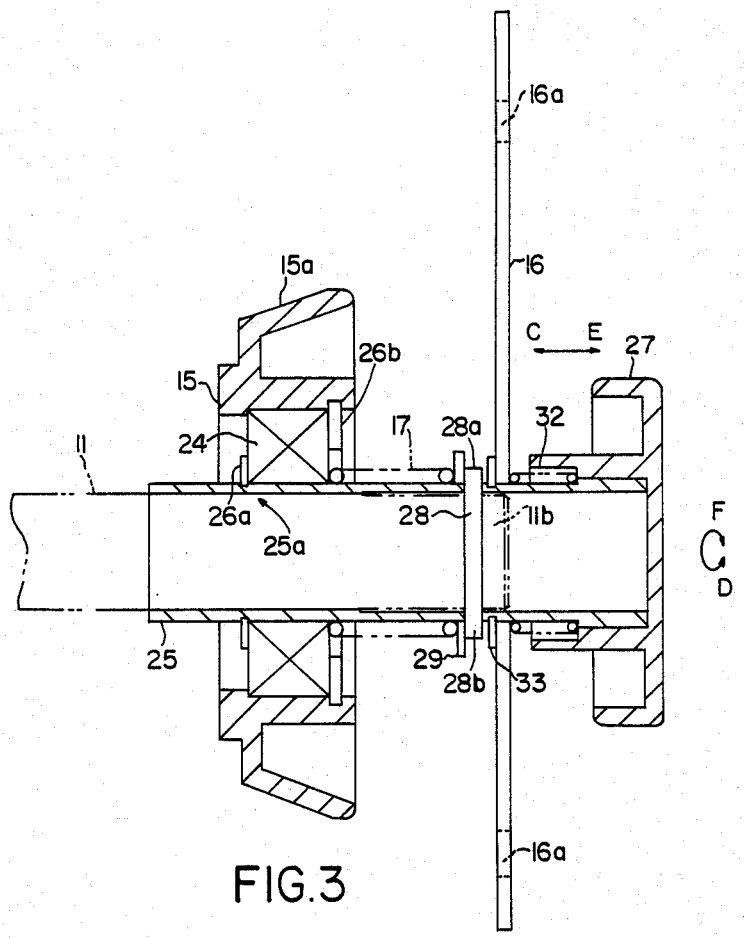
FIG. 3 is a partially enlarged cross-sectional view of the electro-photographic apparatus shown in FIG. 2.

The support flange 15 is a part of the cover assembly 14, as shown more in detail in FIG. 3. The cover assembly 14 consists of: a sleeve 25 having an inner diameter substantially the same as the outer diameter of the center shaft 11; the support flange 15 provided at a first end 25a of the sleeve 25 with a bearing 24; a coil spring 17 provided between the support flange 15 and a stopper washer 29 for forcing the support flange 15 toward the first end 25a, namely in the direction C of the arrow CE; a stopper pin 28 pierced through the sleeve 25; a knob 27 secured at the second end of the sleeve 25; and a cover plate 16 for covering an aperture 23 (FIG. 2) of the front 12b of the frame 12 for drawing the drum member 10 outside the frame 12. The cover plate 16 has one or more positioning holes 16a which receive respective positioning pins 12c of the frame 12. Furthermore, a coil spring 32 is provided on the sleeve 25 between the cover plate 16 and the knob 27 for forcing the cover plate 16 in the direction C of the arrow CE. Members 26a, 26b - and 33 are washers working as stoppers. A tapered rim 15a of the support flange 15 is partially inserted into the second end 10a of the drum member 10.

The center shaft 11 in this embodiment is a pipe, at the second, free end 11b of which there is provided a pair of grooves 31, each having an open portion 31a and a closed portion 31b. The width of the groove 31 is substantially the same as the diameter of the stopper pin 28. FIG. 4A shows a side view of the second end 11b of the center shaft 11 including the groove 31. FIG. 4B shows a flattened view of the circumferential structure of the grooves 31. The groove 31 and the stopper pin 28 form a lock means.

The unloading operation will be explained by referring to FIGS. 2, 3 and 4.

(1) First, by the user pushing the knob 27 in the direction C and then rotating the knob 27 counterclockwise, namely the direction D of the arrow DF, both ends 28a and 28b of the stopper pin 28 are guided along the grooves 31 toward the open portion 31a, and the cover assembly 14 is unlocked from the center shaft 11.

(2) By drawing out the knob 27 in the direction E, the whole cover assembly 14 is removed from the apparatus.

(3) By then removing the sleeve 25 and the support flange 15, the inner support member 18 is pushed out in the direction E by the spring 21 and ejected outside the frame 12 a predetermined length, as shown by a dotted line 18e in FIG. 2, which length can be defined by the position of a stopper screw 22. At the same time, the drum member 10 is also disengaged from the support flange 15, and may be moved with the inner support member 18 due to the friction between them.

(4) Then, the drum member 10 can be further drawn out in the direction E by using the ejected inner support member 18 as a guide means without hitting peripheral devices, because the end of the inner support member 18 is ejected outside of the part 12b of the frame 12.

(5) For re-loading the drum member 10 after it is cleaned, or for loading a new drum member 10, the reverse procedure is carried out. Namely, the drum member 10 is guided by and engaged with the inner support member 18 positioned outside the frame.

(6) Then, while pushing the inner support member 18, together with the drum member 10, inside the frame 12 against the force of the spring 21, the cover assembly 14 is attached to the center shaft 11.

(7) While engaging the stopper pin 28 with the open portion 31a of the groove 31 of the center shaft 11, the cover assembly 14 together with the inner support member 18 and the drum member 10 is further pushed inside while the user rotates the knob 27 in a clockwise direction. Upon hitting the closed portion 31b, the user releases the knob 27, the cover assembly 14 is locked to the center shaft 11, and the drum member 10 is supported between the drive and support flanges, 13 and 15, respectively.

(8) By engaging each positioning hole 16a with each positioning pin 12c, the cover plate 16 is positioned and secured to the frame 12 by the spring 32.

Figure 6:
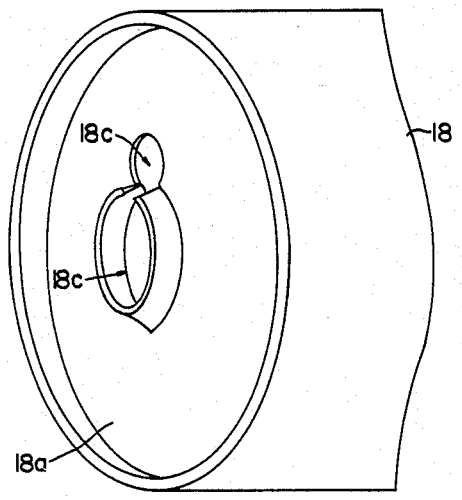
FIG. 6 is a partial perspective view of an inner support member of the embodiment shown in FIG. 2.

The inner support member 18 also can be removed from the center shaft 11, since the flange 18a has a recess 18c, as shown in FIG. 6, for clearing the stopper screw 22. The diameter of an aperture 18*b* of the flange 18*a* is substantially the same as the outer diameter of the center shaft 11. To ensure the stopper function of the stopper screw 22, the inner support member 18 must be rotated, preferably 180°, after being inserted on the center shaft 11.

The length of the center shaft 11 is substantially the same as the length of the drum member 10 in the above embodiment, but this is not necessarily required. For example, the center shaft 11 may be shorter than the drum member 10 if the sleeve 25 of the cover assembly 14 is long enough, and still the inner support member 18 can be ejected as its second end comes outside the front 12*b* of the frame 12. In any case, in order to guide the drum member 10 outside of the front 12*b*, the total length of the center shaft 11 and the inner support member 18 must be longer than the length of the drum member 10.

Figure 7:
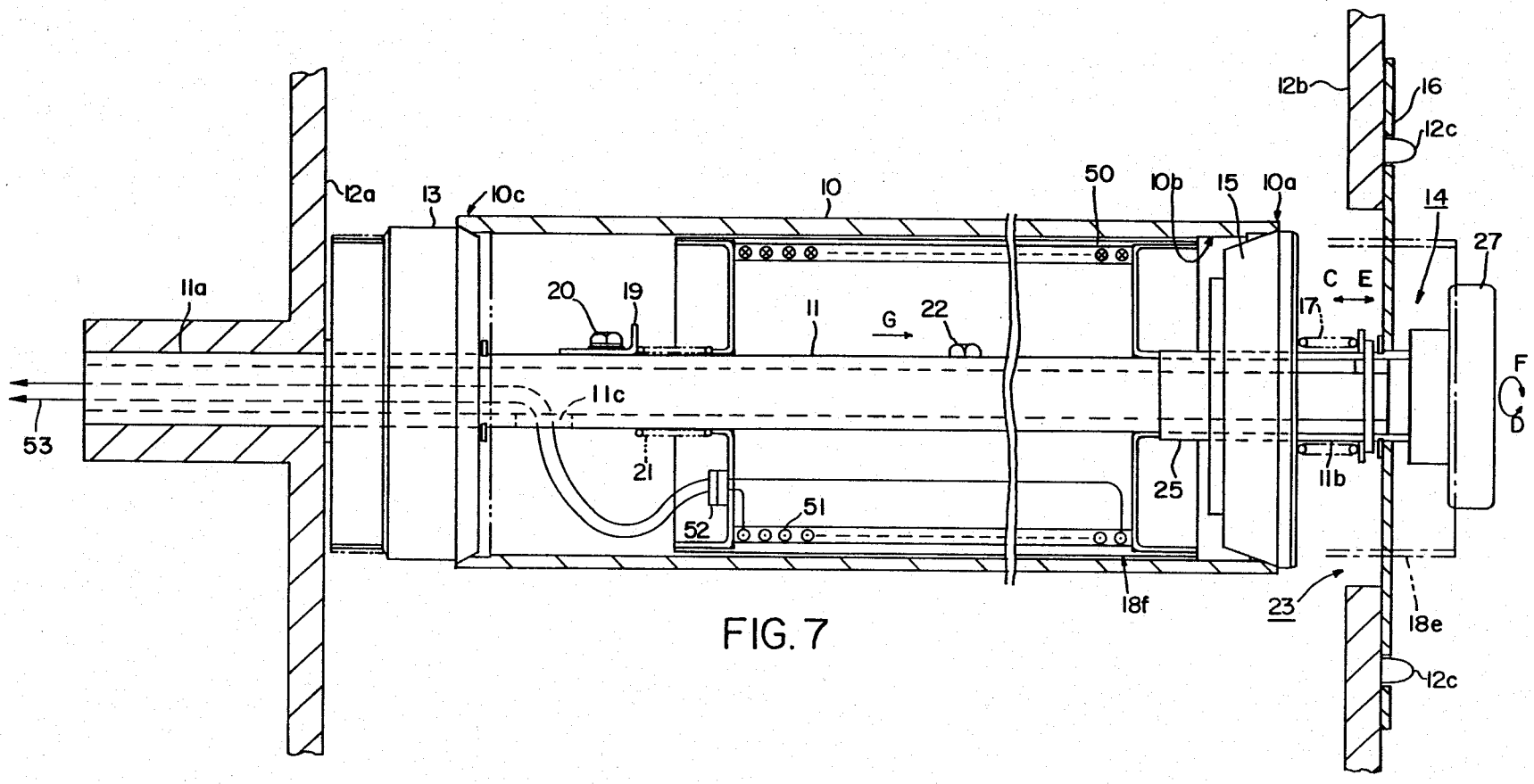
FIG. 7 is a partial cross-sectional view of a second embodiment of an electro-photographic apparatus according to the present invention.

In the above embodiment, the inner support member 18 is a dummy drum which has no function during normal operation of the apparatus. But this inner support member 18 can be used as a heater drum for eliminating any non-uniformity of the temperature of the drum member 10. FIG. 7 shows such a heater drum 50, wherein similar reference numerals represent the similar parts shown in FIG. 2. The heater drum 50 has a heater winding 51 at its inner surface, and lead wires 53 extending through the inside of the center shaft 11 via a hole 11*c* and a connector 52.

Figure 8:
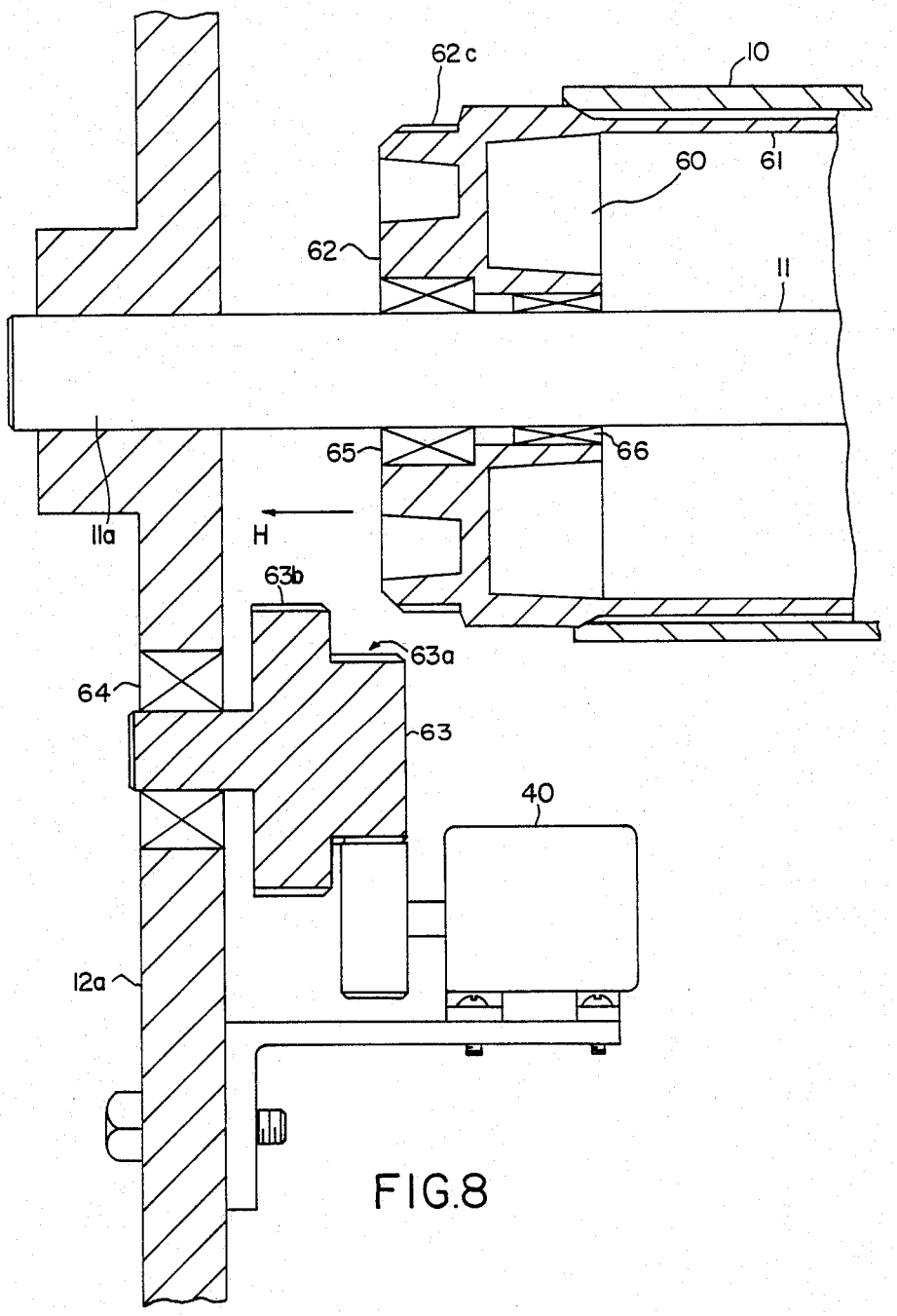
FIG. 8 is a partially enlarged cross-sectional view of a third embodiment of an electro-photographic apparatus according to the present invention.

The drive flange 13 of the first embodiment is described as being driven by the timing belt 36, but this is not necessarily required. For example, a series of gears can be used instead of the timing belt. In such a case, the drive flange can be integrated with the inner support member as shown in FIG. 8. In this figure, 60 is an integrated inner support member having an inner drum portion 61 and a drive flange portion 62. The drive flange portion 62 has a gear portion 62*c* and bearings 65 and 66. An intermediate gear 63 is provided between the center shaft 11 and the motor 40, supported by a bearing 64. The gear 63 has two gear portions 63*a* and 63*b*. The edges of both the gear portions 63*b* and 62*c* are tapered so that they can be easily reengaged when the disengaged inner support member 60 is pushed back in the direction shown by arrow H upon reloading of the drum member 10. The remaining members not shown in FIG. 8 are substantially the same as in FIG. 2. When the drum member 10 is required to be unloaded, the drum member 10 and the inner support member 60 are simultaneously drawn out for a predetermined length, and then only the drum member 10 is further drawn out by using the inner drum portion 61 as a guide means.

Figure 9:
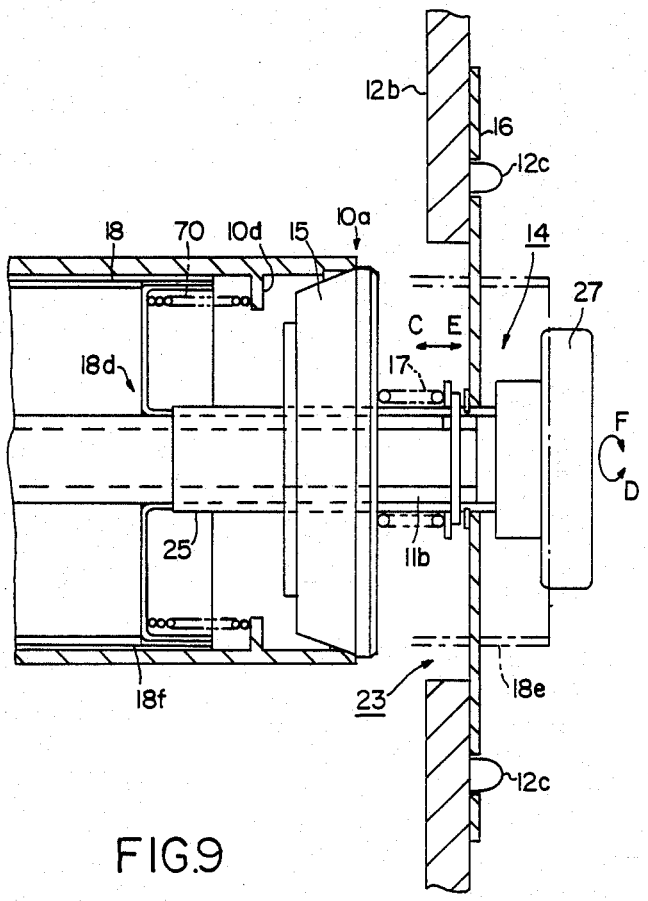
FIG. 9 is a partially enlarged cross-sectional view of a fourth embodiment of an electro-photographic apparatus according to the present invention.

Furthermore, as shown in FIG. 9, a flange portion 10*d* at the outside of the drum member 10 and a coil spring 70 between this flange 10*d* and the flange 18*d* of the inner support member 18 can be provided, so that the drum member 10 is pushed out simultaneously as the inner support member is pushed out by the spring 21, when the cover assembly 14 is removed.

The inner support member 18 is not necessarily a drum, namely it need not have a cylindrical outer surface. It can be a member having a cross-like or a star-like cross section as long as it can support and guide the inner surface of the drum member 10.

Furthermore, it is also possible to provide an inner support member as a sleeve having an outer diameter close to the outer diameter of the center shaft 11, rather than close to the outer diameter of the drum member 10 as in the case of FIG. 2, and to provide a drum member with flanges having an inner diameter substantially the same as the outer diameter of the sleeve.

The foregoing is considered illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention and the appended claims.

We claim:

1. An apparatus for loading/unloading a drum member relative to a frame in which the drum member is used, comprising:

(a) a center shaft secured at a first end thereof to a first end of the frame;

(b) a cylindrical, rigid, inner support member attached to the center shaft to be slidable in the direction of the center shaft axis while being guided by the center shaft to guide said drum member until an end portion of said drum member extends beyond a second end of the frame; and (c) the drum member having an inner surface which is supported by the inner support member to be slidable in the direction of the center shaft axis while being guided by the inner support member, wherein, the length of the inner support member is shorter than the length of the drum member and the total length of both the center shaft and the inner support member is longer than the length of the drum member.

2. The apparatus of claim 1, wherein inner support member is an inner drum whose outer diameter is substantially the same as the inner diameter of the drum member.

3. The apparatus as recited in claim 1, wherein the length of the center shaft is less than the distance between the first and second ends of the frame.

4. The apparatus of claim 2, further comprising:

(a) a first flange member rotatably provided at the first end of the center shaft, having an outer diameter greater than the inner diameter of the drum member;

(b) a second flange member rotatably and detachably provided at a second end of the center shaft, having an outer diameter greater than the inner diameter of the drum member; and (c) first biasing means, provided at the second end of the center shaft, for forcing the second flange member toward the first flange member;

whereby the drum member is sandwiched and supported between the first and the second flange members, and the inner drum is placed inside of the drum member and between the first and the second flange members.

5. The apparatus of claim 2, wherein the drum member is a photosensitive latent image forming drum, and the inner drum is provided with an inner surface including a heater winding.

6. The apparatus of claim 4, wherein the first flange member is formed integrally with the inner drum inseparably.

7. The apparatus of claim 4, further comprising:

(a) second biasing means, provided on the center shaft, for forcing the inner drum toward the second flange member, whereby, by detaching the second flange member, the inner drum is ejected in a direction away from the first end of the center shaft for a predetermined length.

8. The apparatus of claims 1, 2, 4 or 7, wherein the drum member is a photosensitive latent image forming drum.

9. The apparatus of claim 7, further comprising:

(a) third means, provided between the inner drum and the drum member, for forcing the drum member toward the second flange member, whereby, by detaching the second flange member, the drum member is also ejected in a direction away from the first end of the center shaft.

10. The apparatus of claims 7, 5, 6 or 9, further comprising:

(a) means, provided at the second end of the center shaft, for detachably locking the second flange to the center shaft.

11. A method for loading/unloading a drum member relative to a frame, comprising the steps of:

(a) providing a center shaft secured at a first end thereof to firs end of the frame;

(b) providing an cylindrical, rigid, inner support member attached to the center shaft to be slidable in the direction of the center shaft axis and having a length shorter than the length of the drum member;

(c) providing said drum member, supported at an inner surface thereof by the inner support member, to be rotatable on the inner support member and slidable in the direction of the center shaft axis while being guided by the inner support member;

(d) drawing out the inner support member for a predetermined length toward a second end of the center shaft; and (e) drawing out the drum member, while using the inner support member as a guide means, to extend beyond a second end of the frame.

12. The apparatus as recited in claim 11, wherein the length of the center shaft is less than the distance between the first and second ends of the frame.

13. A method for loading/unloading a drum member relative to a frame, the steps of:

(a) providing a center shaft secured at a first end thereof to a first a end of the frame;

(b) providing a cylindrical, rigid, inner support member attached to the center shaft to be slidably in the direction of the center shaft axis and having a length shorter than the length of the drum member;

(c) providing the drum member supported at an inner surface thereof by the inner support member to be slidable in the direction of the center shaft axis being guided by the inner support member;

wherein said inner support member guides said drum member until the end portion of said drum member extends beyond a second end of the frame;

(d) providing means for locking the drum member and the inner support member to the center shaft;

(e) unlocking the locking means;

(f) drawing out the inner support member for a predetermined length toward a second end of the center shaft; and (g) drawing out the drum member, while using the inner support member as guide means, to extend beyond a second end of the frame.

14. The method as recited in claim 13, wherein the length of the center shaft is less than the distance between the first and second ends of the frame.

15. An electro-static photographic apparatus, comprising:

a hollow, latent image forming drum coated on an outer surface thereof with photosensitive material and supported rotatably around a center shaft; and means, provided inside the drum and being slidably attached to the center shaft, for guiding the drum form the inside to the outside of the apparatus, wherein said means is a cylindrical, rigid, inner support member shorter than the drum which guides said drum until an end portion of said drum passes out of the apparatus.

16. The apparatus as recited in claim 15, wherein he length of the center shaft is less than the distance between the first and second ends of the frame.

* * * * *

UNITED STATES PATENT AND TRADEMARK OFFICE

CERTIFICATE OF CORRECTION

PATENT NO. : 4,823,160
DATED : April 18, 1989
INVENTOR(S) : IKUTA et al.

It is certified that error appears in the above-identified patent and that said Letters Patent is hereby corrected as shown below:

Please amend claims 1, 2, 4, 7, 8, 10, 11 and 13 as follows:

1. An apparatus for loading/unloading a drum member relative to a frame in which the drum member is used, comprising:

(a) a frame;

(b) a drum member having first and second end portions;

[a](c) a center shaft secured at a first end thereof to a first end of the frame;

[b](d) a cylindrical, rigid, inner support member attached to the center shaft to be slidable in the direction of the center shaft axis while being guided by the center shaft to guide said drum member [until an] from a position wherein the first end portion of the drum member is adjacent the first end of the frame and the second end portion of the drum member is within the frame, to a position where a significant portion of the support member and [end] a substantial portion of said drum member extend[s] beyond a second PATENT NO. : 4,823,160
DATED : April 18, 1989
INVENTOR(S) : IKUTA et al.

It is certified that error appears in the above-identified patent and that said Letters Patent is hereby corrected as shown below:

end of the frame; and

[c](e) the drum member having an inner surface which is supported substantially along its length by the inner support member to be slidable in the direction of the center shaft axis while being guided by the inner support member, wherein, the length of the inner support member is shorter than the length of the drum member and the total length of both the center shaft and the inner support member is longer than the length of the drum member.

2. The apparatus of claim 1, wherein the inner support member is an inner drum whose outer diameter is substantially the same as but less than the inner diameter of the drum member.

4. The apparatus of claim 2, further comprising:

(a) a first flange member rotatably provided at the first end of the center shaft, having an outer diameter greater than the inner diameter of the drum member;

UNITED STATES PATENT AND TRADEMARK OFFICE

CERTIFICATE OF CORRECTION

PATENT NO. : 4,823,160
DATED : April 18, 1989
INVENTOR(S) : IKUTA et al.

It is certified that error appears in the above-identified patent and that said Letters Patent is hereby corrected as shown below:

(b) a second flange member rotatably and detachably provided at a second end of the center shaft, having an outer diameter greater than the inner diameter of the drum member; and (c) first biasing means, provided at the second end of the center shaft, for forcing the second flange member toward the first flange member;

whereby the drum member is sandwiched and supported between the first and the second flange members, and the inner [drum] <u>support member</u> is placed inside of the drum member and between the first and the second flange members.

7. An apparatus [of claim 3] <u>for loading/unloading a drum member relative to a frame in which the drum member is used, comprising:</u>

<u>(a) a frame;</u>

<u>(b) a drum member having first and second end portions;</u>

It is certified that error appears in the above-identified patent and that said Letters Patent is hereby corrected as shown below:

(c) a center shaft secured at a first end thereof to a first end of the frame;

(d) a cylindrical, rigid, inner support member attached to the center shaft to be slidable in the direction of the center shaft axis while being guided by the center shaft to guide said drum member from a position wherein the first end portion of the drum member is adjacent the first end of the frame and the second end portion of the drum member is within the frame to a position where the second end portion of said drum member extends beyond a second end of the frame, wherein the inner support member is an inner drum whose outer diameter is substantially the same as the inner diameter of the drum member; and (e) the drum member having an inner surface which is supported by the inner support member to be slidable in the direction of the center shaft axis while being guided by the inner support member, wherein, the length of the inner support member is shorter than the length of the drum member and the It is certified that error appears in the above-identified patent and that said Letters Patent is hereby corrected as shown below:

total length of both the center shaft and the inner support member is longer than the length of the drum member;

(f) a first flange member rotatably provided at the first end of the center shaft, having an outer diameter greater than the inner diameter of the drum member;

(g) a second flange member rotatably and detachably provided at a second end of the center shaft, having an outer diameter greater than the inner diameter of the drum member;

(h) first biasing means, provided at the second end of the center shaft, for forcing the second flange member toward the first flange member, whereby the drum member is sandwiched and supported between the first and the second flange members, and the inner drum is placed inside of the drum member and between the first and the second flange members; and It is certified that error appears in the above-identified patent and that said Letters Patent is hereby corrected as shown below:

(i) second biasing means, provided on the center shaft, for forcing the inner drum toward the second flange member, whereby, by detaching the second flange member, the inner drum is ejected in a direction away from the first end of the center shaft for a predetermined length.

8. The apparatus of claim [1, 2, 3, or] 7, wherein the drum member is a photosensitive latent image forming drum.

10 The apparatus of claims 7 [, 6, 7] or 9 further comprising:

[(a)] means, provided at the second end of the center shaft, for detachably locking the second flange to the center shaft.

11. A method for loading/unloading a drum member relative to a frame, comprising the steps of:

<u>(a)</u> <u>providing a frame;</u>

UNITED STATES PATENT AND TRADEMARK OFFICE

CERTIFICATE OF CORRECTION

PATENT NO. : 4,823,160
DATED : April 18, 1989
INVENTOR(S) : IKUTA et al.

It is certified that error appears in the above-identified patent and that said Letters Patent is hereby corrected as shown below:

(b) providing a drum member having first and second end portions;

[(a)] (c) providing a center shaft secured at a first end thereof to first end of the frame;

[(b)] (d) providing a cylindrical, rigid, inner support member attached to the center shaft to be slidable in the direction of the center shaft axis and having a length shorter than the length of the drum member;

[(c)] (e) providing said drum member, supported substantially along its length at an inner surface thereof by the inner support member, to be rotatable on the inner support member and slidable in the direction of the center shaft axis while being guided by the inner support member;

[(d)] (f) drawing out the inner support member [for a predetermined length] toward a second end of the center shaft; and

[(e)] (g) drawing out the drum member, while using the inner support member as a guide means, [to PATENT NO. : 4,823,160
DATED : April 18, 1989
INVENTOR(S) : IKUTA et al.

It is certified that error appears in the above-identified patent and that said Letters Patent is hereby corrected as shown below:

extend] from a position wherein the first end portion of the drum member is adjacent the first end of the frame and the second end portion of the drum member is within the frame, to a position where a significant portion of the support member and a substantial portion of said drum member extend beyond a second end of the frame.

13. A method for loading/unloading a drum member relative to a frame, comprising the steps of :

(a) providing a frame;

(b) providing a drum member having first and second end portions;

[(a)] (c) providing a center shaft secured at a first end thereof to a first end of the frame;

[(b)] (d) providing a cylindrical, rigid, inner support member attached to the center shaft to be slidable in the direction of the center shaft axis and having a length shorter than the length of the drum member;

UNITED STATES PATENT AND TRADEMARK OFFICE

CERTIFICATE OF CORRECTION

PATENT NO. : 4,823,160
DATED : April 18, 1989
INVENTOR(S) : IKUTA et al.

It is certified that error appears in the above-identified patent and that said Letters Patent is hereby corrected as shown below:

[(c)] (e) providing the drum member supported at an inner surface thereof by the inner support member to be slidable in the direction of the center shaft axis being guided by the inner support member;

[wherein said inner support member guides said drum member until the end extends beyond a second end of the frame;]

[(d)] (f) providing means for locking the drum member and inner support member to the center shaft;

[(e)] (g) unlocking the locking means;

[(f)] (h) drawing out the inner support member [for a predetermined length] toward a second end of the center shaft; and

UNITED STATES PATENT AND TRADEMARK OFFICE

CERTIFICATE OF CORRECTION

PATENT NO. : 4,823,160

DATED : April 18, 1989

INVENTOR(S) : IKUTA et al.

It is certified that error appears in the above-identified patent and that said Letters Patent is hereby corrected as shown below:

[(g)] (i) drawing out the drum member, while using the inner support member as guide means, [to] from a position wherein the first end portion of the drum member is adjacent the first end of the frame and the second end portion of the drum member is within the frame, to a position wherein a significant portion of the support member and a substantial portion of said drum member extend beyond a second end of the frame.

Signed and Sealed this

Tenth Day of April, 1990

*Attest:*

*Attesting Officer*

HARRY F. MANBECK, JR.

*Commissioner of Patents and Trademarks*